US010192485B2

(12) United States Patent
He et al.

(10) Patent No.: US 10,192,485 B2
(45) **Date of Patent: *Jan. 29, 2019**

(54) PIXEL COMPENSATION CIRCUIT AND AMOLED DISPLAY DEVICE

(71) Applicants: Boe Technology Group Co., Ltd., Beijing (CN); Chengdu Boe Optoelectronics Technology Co., Ltd., Sichuan Province (CN)

(72) Inventors: Xiaoxiang He, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 10 days.

This patent is subject to a terminal disclaimer.

(21) Appl. No.: 15/503,101

(22) PCT Filed: Jul. 4, 2016

(86) PCT No.: PCT/CN2016/088313
§ 371 (c)(1),
(2) Date: Feb. 10, 2017

(87) PCT Pub. No.: WO2017/117939
PCT Pub. Date: Jul. 13, 2017

(65) Prior Publication Data

US 2018/0114487 A1 Apr. 26, 2018

(30) Foreign Application Priority Data

Jan. 4, 2016 (CN) ..... 2016 1 0004123

(51) Int. Cl.
*G09G 3/32* (2016.01)
*G09G 3/3258* (2016.01)
*G09G 3/3233* (2016.01)

(52) U.S. Cl.
CPC ..... *G09G 3/3258* (2013.01); *G09G 3/32* (2013.01); *G09G 3/3233* (2013.01);
(Continued)

(58) Field of Classification Search
CPC ..... G09G 3/3233; G09G 3/3258; G09G 2300/0426; G09G 2300/043;
(Continued)

(56) References Cited

U.S. PATENT DOCUMENTS 7,724,218 B2 5/2010 Kim et al.
7,889,159 B2 2/2011 Nathan et al.
(Continued)

FOREIGN PATENT DOCUMENTS

CA 2490848 A1 5/2006
CA 2503283 A1 10/2006
(Continued)

OTHER PUBLICATIONS

International Search Report for PCT/CN2016/088313 dated Nov. 21, 2016.
(Continued)

*Primary Examiner* — Tom V Sheng
(74) *Attorney, Agent, or Firm* — Calfee Halter & Griswold LLP

(57) ABSTRACT

A pixel compensation circuit includes a data signal writing module, a high voltage writing module, a first reference voltage generation module, a driving transistor, a capacitor and a light emitting device. The data signal writing module is connected to a first end of the capacitor. The high voltage writing module is connected to the first end of the capacitor.
(Continued)

The first reference voltage generation module is connected to a second end of the capacitor, an anode of the light emitting device and a drain electrode of the driving transistor. A gate electrode of the driving transistor is connected to the second end of the capacitor, a source electrode thereof is connected to the high voltage writing module, and the drain electrode thereof is connected to the anode of the light emitting device. A cathode of the light emitting device is connected to a common grounding electrode.

12 Claims, 6 Drawing Sheets

(52) U.S. Cl.
CPC ..... *G09G 2300/0426* (2013.01); *G09G 2300/0871* (2013.01); *G09G 2320/0233* (2013.01); *G09G 2320/045* (2013.01)

(58) Field of Classification Search
CPC ... G09G 2300/0809; G09G 2300/0819; G09G 2300/0871; G09G 2310/0251; G09G 2320/0233; G09G 2320/045; G09G 3/32
See application file for complete search history.

(56) References Cited

U.S. PATENT DOCUMENTS

| | | | | |
|---|---|---|---|---|
| 7,995,008 | B2 | 8/2011 | Miwa | |
| 8,319,712 | B2 | 11/2012 | Nathan et al. | |
| 8,614,652 | B2 | 12/2013 | Nathan et al. | |
| 9,111,488 | B2 | 8/2015 | Kwak | |
| 9,548,020 | B2 * | 1/2017 | Kim | G09G 3/3233 |
| 9,564,082 | B2 * | 2/2017 | Qing | G09G 3/3225 |
| 9,870,082 | B2 * | 1/2018 | Hu | G06F 3/0412 |
| 2005/0052377 | A1 * | 3/2005 | Hsueh | G09G 3/3233 345/82 |
| 2006/0125408 | A1 | 6/2006 | Nathan et al. | |
| 2006/0221009 | A1 | 10/2006 | Miwa | |
| 2007/0279337 | A1 | 12/2007 | Kim et al. | |
| 2010/0039458 | A1 | 2/2010 | Nathan et al. | |
| 2010/0207920 | A1 * | 8/2010 | Chaji | G09G 3/3233 345/211 |
| 2010/0220091 | A1 | 9/2010 | Choi | |
| 2011/0134094 | A1 | 6/2011 | Nathan et al. | |
| 2013/0088474 | A1 * | 4/2013 | Wang | G09G 3/3258 345/211 |
| 2014/0085359 | A1 | 3/2014 | Nathan et al. | |
| 2014/0145917 | A1 | 5/2014 | Kwak | |
| 2014/0361708 | A1 | 12/2014 | Nathan et al. | |
| 2016/0240136 | A1 | 8/2016 | Han | |
| 2016/0246409 | A1 * | 8/2016 | Yang | G06F 3/0412 |
| 2016/0247449 | A1 * | 8/2016 | Yin | G09G 3/3233 |
| 2016/0253958 | A1 * | 9/2016 | Ma | G09G 3/3225 345/211 |
| 2017/0039934 | A1 * | 2/2017 | Ma | G09G 3/3208 |
| 2017/0061868 | A1 * | 3/2017 | Tseng | G09G 3/3233 |
| 2017/0154576 | A1 * | 6/2017 | Sun | G09G 3/3258 |
| 2017/0162120 | A1 * | 6/2017 | Hung | G09G 3/3233 |
| 2017/0200414 | A1 * | 7/2017 | Li | G09G 3/3258 |
| 2017/0269747 | A1 * | 9/2017 | Hu | G06F 3/0412 |

FOREIGN PATENT DOCUMENTS

| | | | |
|---|---|---|---|
| CA | 2523841 | C | 8/2007 |
| CA | 2660598 | A1 | 6/2009 |
| CA | 2523841 | A1 | 1/2016 |
| CN | 101111880 | | 1/2008 |
| CN | 102057418 | | 5/2011 |
| CN | 103021333 | A | 4/2013 |
| CN | 103839513 | | 6/2014 |
| CN | 103996379 | | 8/2014 |
| CN | 203882588 | U | 10/2014 |
| CN | 104680977 | | 6/2015 |
| CN | 105448244 | | 3/2016 |
| CN | 105609050 | | 5/2016 |
| EP | 1825455 | | 8/2007 |
| EP | 2277163 | | 1/2011 |
| EP | 2383721 | A2 | 11/2011 |
| EP | 2736036 | A2 | 5/2014 |
| EP | 2383721 | B1 | 4/2015 |
| WO | 2006053424 | A1 | 5/2006 |
| WO | 2009127065 | A1 | 10/2009 |

OTHER PUBLICATIONS

First Chinese Office Action for Application No. 201610004123.1 dated Aug. 1, 2017.

* cited by examiner

PIXEL COMPENSATION CIRCUIT AND AMOLED DISPLAY DEVICE

CROSS REFERENCE TO RELATED APPLICATIONS

The present application is a US national phase of PCT Application No. PCT/CN2016/088313, filed on Jul. 4, 2016, which is based upon and claims priority to Chinese Patent Application No. 201610004123.1, filed on Jan. 4, 2016, and the entire contents thereof are incorporated herein by reference.

TECHNICAL FIELD

The present disclosure relates to the field of display technology, and more particularly, to a pixel compensation circuit and an AMOLED display device.

BACKGROUND

Flat display devices have been widely used due to their advantages such as slimness, low power consumption, non-radiation, and the like. A currently available flat display device mainly includes a liquid crystal display device (LCD) and an organic light emitting diode (OLED) display device.

An OLED display device displays an image by self-illumination, and thus does not require any backlight. Accordingly, the OLED display device is regarded as a next generation of display device that may replace the LCD due to its outstanding characteristics such as high contrast ratio, small thickness, wide viewing angle, fast response speed, flexibility, wide operating temperature range, simple structure and manufacturing process, and the like.

The OLED may be classified into two major types of a passive matrix OLED (PMOLED) and an active matrix OLED (AMOLED) according to a driving scheme, which may correspond to two types of a directly addressing type and a thin film transistor (TFT) matrix addressing type. The PMOLED has relative high power consumption and thus is not suitable for large sized display devices. Accordingly, the PMOLED is generally used in small sized display devices. The AMOLED is generally used in large sized display devices with high definition due to its high luminous efficacy.

FIG. 1 illustrates a circuit diagram of a pixel circuit of an AMOLED in the prior art. In a display region of the AMOLED display device, pixels are arranged in a matrix of a plurality of rows and columns, and each pixel is generally driven by a pixel circuit including two TFTs and a capacitor, i.e., each pixel is driven by a 2T1C driving scheme. In particular, a gate electrode of a first transistor T1 is electrically connected to the gate line Scan, a source electrode of the first transistor T1 is electrically connected to the data signal line DATA, and a drain electrode of the first transistor T1 is electrically connected to a gate electrode of a second transistor T2 and one end of a capacitor C. A source electrode of the second transistor T2 is electrically connected to a high voltage signal terminal VDD, and a drain electrode of the second transistor T2 is electrically connected to an anode of an OLED D. A cathode of the OLED D is electrically connected to a common grounding electrode VSS. The one end of the capacitor C is electrically connected to the drain electrode of the first transistor T1, and the other end of the capacitor C is electrically connected to the source electrode of the second transistor T2. While displaying an image, the gate line Scan controls the first transistor T1 to be turned on, and a data signal voltage from the data signal line DATA is provided to the gate electrode of the second transistor T2 and the capacitor C through the first transistor T1. Afterwards, the first transistor T1 is turned off, and a voltage at the gate electrode of the second transistor T2 may be maintained at the data signal voltage due to the capacitor C, such that the second transistor T2 is turned on. Accordingly, a driving current corresponding to the high voltage signal terminal VDD and the data signal voltage may be provided to the OLED D through the second transistor T2, thereby driving the OLED D to emit light.

In the above AMOLED display device, the OLED D is driven according to the current generated under a saturated state of the second transistor T2. However, a critical voltage of the second transistor T2 in each pixel may be different due to the non-uniformity of the TFT manufacturing process. Also, various shifts may occur in the threshold voltage Vth of the second transistor T2 during the illumination of the OLED D. Accordingly, while driving the OLED with the above 2T1C driving circuit, the respective pixels may have a poor brightness uniformity, resulting in a defect such as display unevenness.

It should be noted that, information disclosed in the above background portion is provided only for better understanding of the background of the present disclosure, and thus it may contain information that does not form the prior art known by those ordinary skilled in the art.

SUMMARY

The present disclosure provides a pixel compensation circuit and an AMOLED display device including the pixel compensation circuit.

Embodiments of the present disclosure provide a pixel compensation circuit including a data signal writing module, a high voltage writing module, a first reference voltage generation module, a driving transistor, a capacitor and a light emitting device. The data signal writing module is connected to a first end of the capacitor. The high voltage writing module is connected to the first end of the capacitor. The first reference voltage generation module is connected to a second end of the capacitor, an anode of the light emitting device and a drain electrode of the driving transistor. A gate electrode of the driving transistor is connected to the second end of the capacitor, a source electrode of the driving transistor is connected to the high voltage writing module, and the drain electrode of the driving transistor is connected to the anode of the light emitting device. A cathode of the light emitting device is connected to a common grounding electrode.

Embodiments of the present disclosure further provide a pixel compensation circuit, wherein the pixel compensation circuit comprises a data signal writing module, a high voltage writing module, a first reference voltage generation module, a driving transistor, a capacitor and a light emitting device. The data signal writing module is connected to a first end of the capacitor. The high voltage writing module is connected to the first end of the capacitor. The first reference voltage generation module is connected to a second end of the capacitor, an anode of the light emitting device and a drain electrode of the driving transistor. A gate electrode of the driving transistor is connected to the second end of the capacitor, a source electrode of the driving transistor is connected to the high voltage writing module, and the drain electrode of the driving transistor is connected to the anode of the light emitting device. A cathode of the light emitting device is connected to a common grounding electrode.

It is to be understood that both the foregoing general description and the following detailed description are exemplary and explanatory only and are not restrictive of the invention, as claimed.

This section provides a summary of various implementations or examples of the technology described in the disclosure, and is not a comprehensive disclosure of the full scope or all features of the disclosed technology.

BRIEF DESCRIPTION OF THE DRAWINGS

The accompanying drawings, which constitute a part of this specification, provide further explanation of the present disclosure and, together with the following detailed implementations, serve to explain the present disclosure, rather than limiting the present disclosure. In the drawings.

DETAILED DESCRIPTION

Hereinafter, detailed implementations of the present disclosure will be described in detail with reference to the accompanying drawings. It should be appreciated that the detailed implementations described herein serve to illustrate and explain the present disclosure only, rather than limiting the present disclosure.

Figure 1:
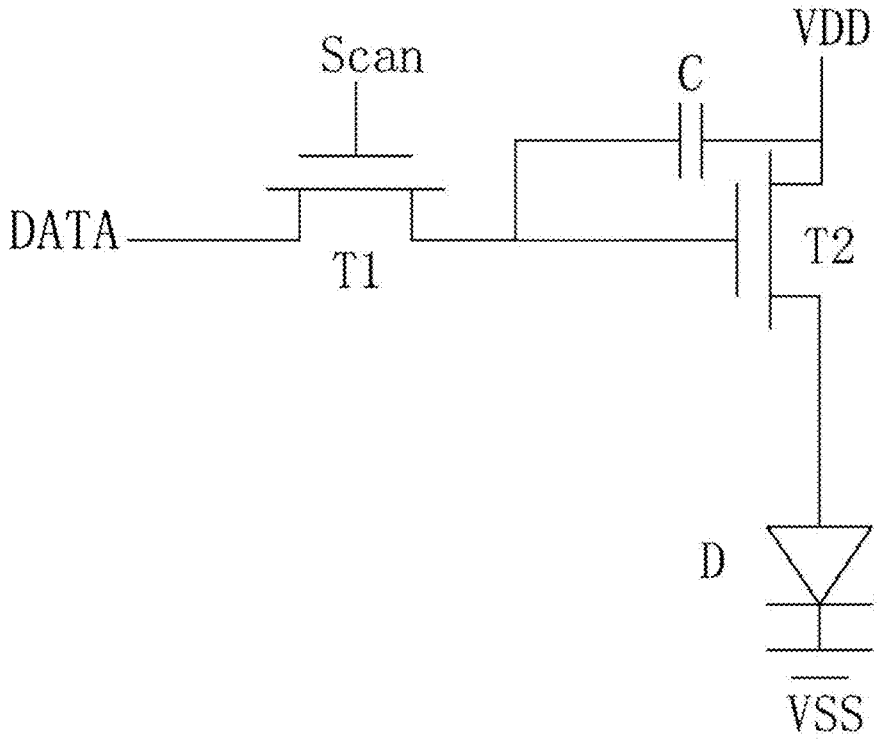
Fig. 1 (Prior Art)
FIG. 1 is a circuit diagram of a pixel circuit of an AMOLED in the prior art.
Figure 2:
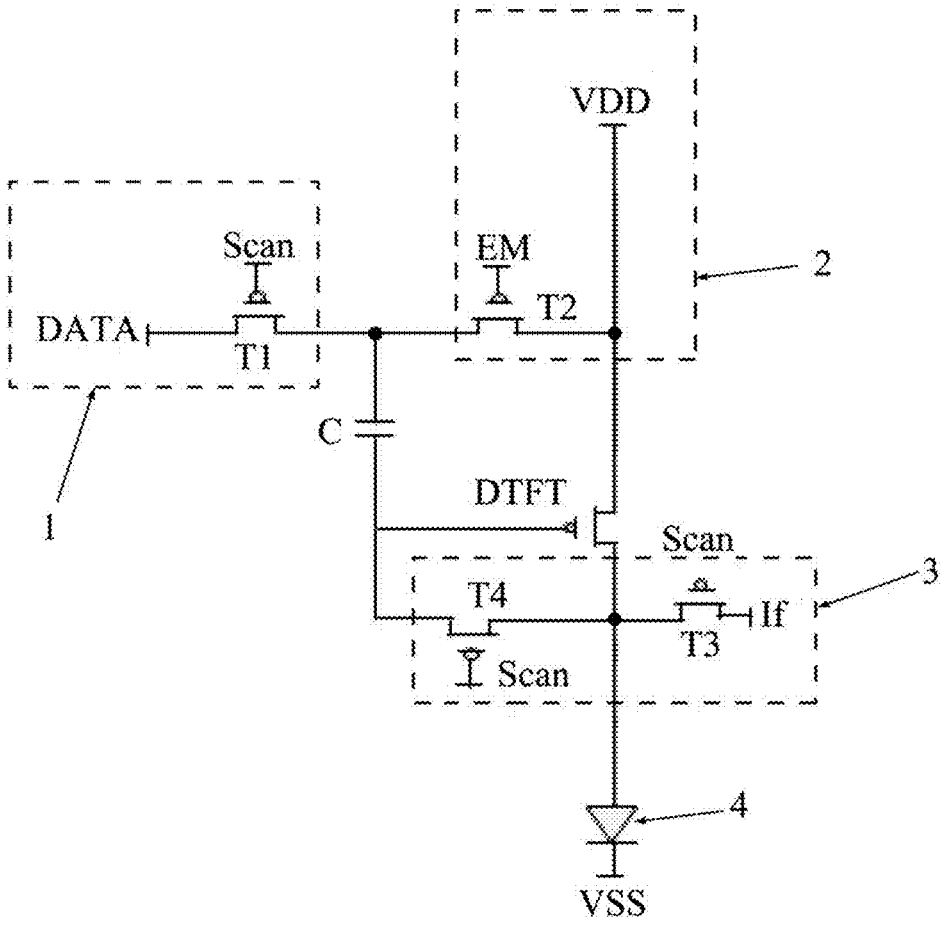
FIG. 2 is a circuit diagram illustrating a pixel compensation circuit according to embodiments of the present disclosure.

FIG. 2 illustrates a circuit diagram of the pixel compensation circuit according to embodiments of the present disclosure. As illustrated in FIG. 2, the pixel compensation circuit includes a data signal writing module 1, a high voltage writing module 2, a first reference voltage generation module 3, a driving transistor DTFT, a capacitor C and a light emitting device 4. The data signal writing module 1 is connected to a first end of the capacitor C. The high voltage writing module 2 is connected to the first end of the capacitor C. The first reference voltage generation module 3 is connected to a second end of the capacitor C, an anode of the light emitting device 4 and a drain electrode of the driving transistor DTFT. A gate electrode of the driving transistor DTFT is connected to the second end of the capacitor C, a source electrode of the driving transistor DTFT is connected to the high voltage writing module 2, and the drain electrode of the driving transistor DTFT is connected to the anode of the light emitting device 4. A cathode of the light emitting device 4 is connected to a common grounding electrode VSS. The light emitting device 4 may be an organic light emitting diode (OLED).

In particular, as illustrated in FIG. 2, the data signal writing module 1 includes a data signal line DATA and a first transistor T1. A control electrode (i.e., the gate electrode) of the first transistor T1 is connected to a gate line Scan, a source electrode of the first transistor T1 is connected to the data signal line DATA, and a drain electrode of the first transistor T1 is connected to the first end of the capacitor C.

The high voltage writing module 2 includes a high voltage signal terminal VDD and a second transistor T2. A control electrode (i.e., the gate electrode) of the second transistor T2 is connected to a light emitting signal terminal EM, a source electrode of the second transistor T2 is connected to the high voltage signal terminal VDD, and a drain electrode of the second transistor T2 is connected to the first end of the capacitor C.

In addition, the first reference voltage generation module 3 includes a reference current terminal If, a third transistor T3 and a fourth transistor T4. A control electrode (i.e., the gate electrode) of the third transistor T3 is connected to the gate line Scan, a source electrode of the third transistor T3 is connected to the reference current terminal If, and a drain electrode of the third transistor T3 is connected to a source electrode of the fourth transistor T4, the drain electrode of the driving transistor DTFT and the anode of the light emitting device 4. A control electrode (i.e., the gate electrode) of the fourth transistor T4 is connected to the gate line Scan, and a drain electrode of the fourth transistor T4 is connected to the second end of the capacitor C.

Figure 3:
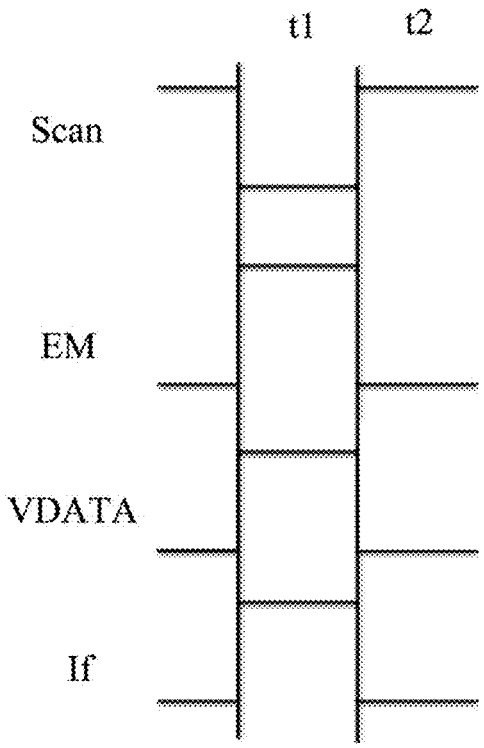
FIG. 3 is a timing diagram of respective signals in the pixel compensation circuit illustrated in FIG. 2.

In the present embodiment, each of the first transistor T1, the second transistor T2, the third transistor T3, the fourth transistor T4 and the driving transistor DTFT may be a P-type transistor. In this case, the timings of the respective signals are illustrated in FIG. 3. Hereinafter, a process of driving the light emitting device to emit light using the pixel compensation circuit illustrated in FIG. 2 will be described in detail with reference to the timing diagram illustrated in FIG. 3.

A first period t1 is a period during which the light emitting device 4 does not emit light. In particular, during the first period t1, the scan signal output from the gate line Scan has a low level, the light emitting signal output from the light emitting signal terminal EM has a high level, and the data signal output from the data signal line DATA has a high level. In this case, the first transistor T1 is turned on, the second transistor T2 is turned off, and the third transistor T3 and the fourth transistor T4 are turned on. The equivalent circuit diagram at this time is illustrated in FIG. 4.

Figure 4:
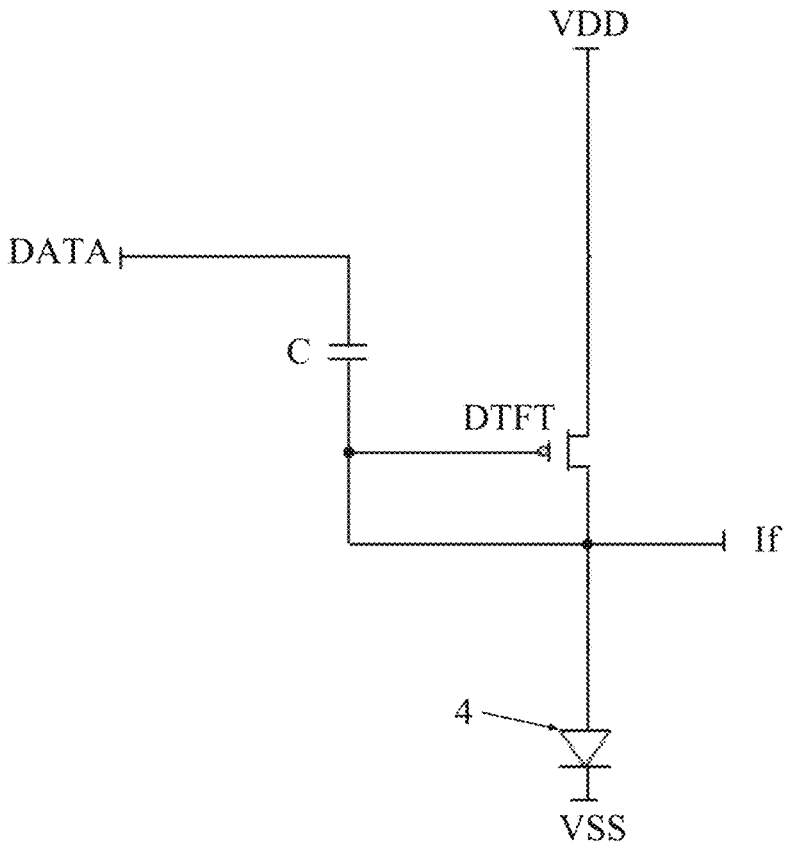
FIG. 4 is an equivalent circuit diagram during the period t1.

Referring to FIG. 4, the data signal line DATA is connected to the first end of the capacitor C and inputs the data signal to the first end of the capacitor C, such that the a voltage at the first end of the capacitor C is VDATA. Meanwhile, the high voltage signal terminal VDD is connected to the source electrode of the driving transistor DTFT, such that a voltage at the source electrode of the driving transistor DTFT equals to VDD.

In addition, the reference current terminal If is connected to the second end of the capacitor C, that is, the reference current terminal If is connected to the gate electrode of the driving transistor DTFT. The reference current terminal If provides a reference current If which is a set value. In the case where the reference current terminal If provides a reference current If, the reference current If may satisfy the following equation (1).

$$If=k(Vgs-Vth)^2 \quad (1)$$

In the above equation (1), k denotes a constant associated with the driving transistor DTFT, Vth denotes a threshold voltage of the driving transistor DTFT, and Vgs denotes a voltage difference between the gate electrode and the source electrode of the driving transistor DTFT, i.e., Vgs=g−Vs, wherein Vg denotes a gate electrode voltage of the driving transistor DTFT, and Vs denotes a source electrode voltage of the driving transistor DTFT.

During the period t1, the source electrode voltage of the driving transistor DTFT is VDD, and thus the above equation (1) may be transformed into the following equation (2).

$$If=k(Vg-VDD-Vth)^2 \quad (2)$$

According to the above equation (2), the gate electrode voltage Vg of the driving transistor DTFT may be calculated as follow.

$$vg=\sqrt{If/k}+VDD+Vth \quad (3)$$

The calculated voltage Vg is the voltage at the gate electrode of the driving transistor DTFT during the period t1, i.e., a voltage at the second end of the capacitor C that is written by the reference current terminal If.

In practice, the magnitude of the voltage Vg written at the second end of the capacitor C and the gate electrode of the driving transistor DTFT may be controlled by setting a value of the reference current If, such that the required voltage is maintained at the gate electrode of the driving transistor DTFT during the period t1.

As illustrated in FIG. 4, during the period t1, the anode of the light emitting device 4 is also connected to the reference current terminal If and the second end of the capacitor C. Accordingly, the gate electrode voltage Vg is also written at the anode of the light emitting device 4, thereby cleaning a voltage remained at the anode of the light emitting device 4 when the last frame of image is finished, such that the light emitting device 4 has accurate brightness without any error during the current frame of image.

According to the above disclosure, during the period t1, a voltage difference Δs across both ends of the capacitor C may be calculated as follow:

$$\Delta s=Vg-V\mathrm{DATA}=\sqrt{If/k}+VDD+Vth-V\mathrm{DATA} \quad (4)$$

A second period t2 is a period during which the light emitting device 4 emits light. In particular, during the second period t2, the scan signal output from the gate line Scan has a high level, the light emitting signal output from the light emitting signal terminal EM has a low level, and the data signal output from the data signal line DATA has a low level. In this case, the first transistor T1 is turned off, the second transistor T2 is turned on, and the third transistor T3 and the fourth transistor T4 are turned off. The equivalent circuit diagram at this time is illustrated in FIG. 5.

Figure 5:
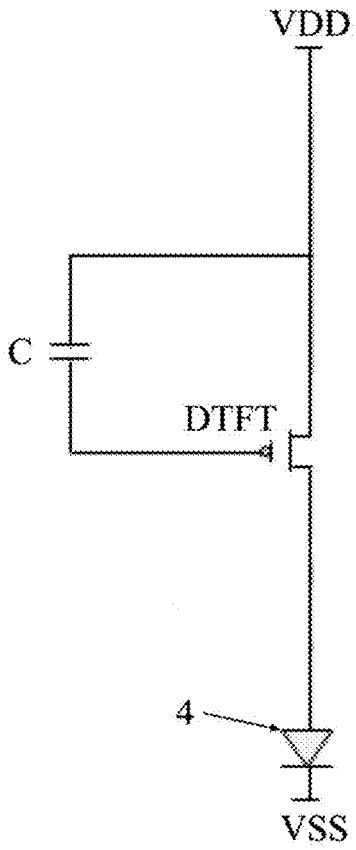
FIG. 5 is an equivalent circuit diagram during the period t2.

Referring to FIG. 5, the high voltage signal terminal VDD is connected to the first end of the capacitor C and writes a voltage at the first end of the capacitor C, such that the voltage at the first end of the capacitor C is changed to VDD from VDATA. In addition, during this period, the high voltage signal terminal VDD is continuously connected to the source electrode of the driving transistor DTFT, such that a voltage at the source electrode of the driving transistor DTFT is maintained as VDD. On the other hand, during the period t2, the second end of the capacitor C is floated, and when the voltage at the first end of the capacitor C is changed to VDD from VDATA, the voltage at the second end of the capacitor C will be changed correspondingly to keep the voltage across both ends of the capacitor C unchanged. Accordingly, the voltage difference Δs across both ends of the capacitor C is maintained as:

$$\Delta s=Vg-V\mathrm{DATA}=\sqrt{If/k}+VDD+Vth-V\mathrm{DATA} \quad (4)$$

The voltage at the first end of the capacitor C equals to that at the source electrode of the driving transistor DTFT, and the voltage at the second end of the capacitor C equals to that at the gate electrode of the driving transistor DTFT. Accordingly, the voltage difference Vgs between the gate electrode and the source electrode of the driving transistor DTFT equals to the above value of Δs.

Accordingly, it can be seen that during the period t2, a current for driving the light emitting device 4 to emit light generated according to the driving transistor DTFT is:

$$\begin{aligned} I_{OLED} &= k(Vgs-Vth)^2 \quad (5) \\ &= k(\sqrt{If/k}+VDD+Vth-VDATA-Vth)^2 \\ &= k(\sqrt{If/k}+VDD-VDATA)^2 \end{aligned}$$

According to the above equation (5), the current $I_{OLED}$ for driving the light emit device 4 to emit light is irrelevant to the threshold voltage Vth of the driving transistor DTFT. Accordingly, brightness of the light emitting device 4 will not be affected by the uniformity of the manufacturing process of the driving transistor DTFT and the shift occurred in the threshold voltage Vth thereof during the illumination, thereby preventing a brightness change of the light emitting device 4 during the illumination and improving brightness uniformity during the illumination.

In addition, during the period t2, since the capacitor C is floated, when a voltage at the high voltage signal terminal VDD has changed, the voltage difference Vgs between the gate electrode and the source electrode of the driving transistor DTFT will remain unchanged, such that the generated driving current $I_{OLED}$ does not change according to the change of the voltage at the high voltage signal terminal VDD. Accordingly, it is possible to further ensure the driving current $I_{OLED}$ to be held steady, thereby preventing a brightness change of the light emitting device 4 during the illumination and improving brightness uniformity during the illumination.

Figure 6:
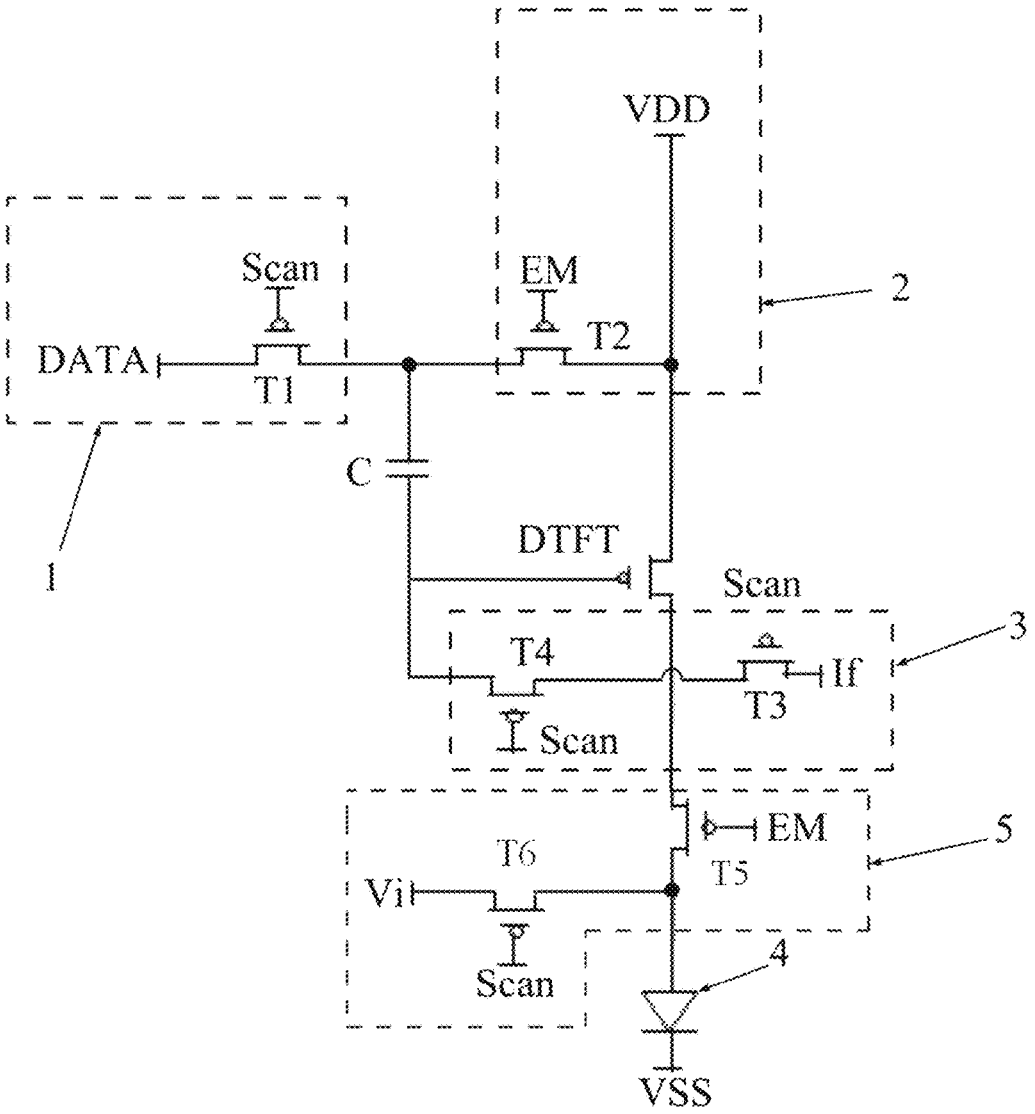
FIG. 6 is a circuit diagram illustrating a pixel compensation circuit according to embodiments of the present disclosure.

FIG. 6 illustrates a circuit diagram of a pixel compensation circuit according to embodiments of the present disclosure. As illustrated in FIG. 6, the present embodiment differs from the previous embodiment in that the pixel compensation circuit in the present embodiment further includes a voltage cleaning module 5. The voltage cleaning module 5 is connected between the drain electrode of the driving transistor DTFT and the anode of the light emitting device 4 to input a second reference voltage Vi to the anode of the light emitting device 4.

In particular, the voltage cleaning module 5 includes a second reference voltage signal terminal Vi, a fifth transistor T5 and a sixth transistor T6. A control electrode of the fifth transistor T5 is connected to the light emitting signal terminal EM, a source electrode of the fifth transistor T5 is connected to the drain electrode of the driving transistor DTFT, and a drain electrode of the fifth transistor T5 is connected to the anode of the light emitting device 4. A control electrode of the sixth transistor T6 is connected to the gate line, a source electrode of the sixth transistor T6 is connected to the second reference voltage signal terminal Vi, and a drain electrode of the sixth transistor T6 is connected to the anode of the light emitting device 4.

In the present embodiment, the timings of respective signals are the same as those in the previous embodiment. In particular, during the first period t1, the fifth transistor T5 is turned off and the sixth transistor T6 is turned on. In this case, the driving transistor DTFT and the second end of the capacitor C are disconnected from the light emitting device 4, and the second reference voltage signal terminal Vi is connected to the anode of the light emitting device 4.

Accordingly, in the present embodiment, during the period t1, instead of the gate voltage Vg in the previous embodiment, the second reference voltage Vi is inputted at the anode of the light emitting device 4 to clean the voltage remained at the anode of the light emitting device 4 when the last frame of image is finished.

In the present embodiment, a separate voltage cleaning module 5 is used to clean the voltage at the anode of the light emitting device 4, such that the first reference voltage generation module 3 is required to write voltage at the second end of the capacitor C only, so as to ensure a voltage difference Δs between both ends of the capacitor C satisfying the equation (4), while it is unnecessary to write voltage at the anode of the light emitting device 4. Firstly, in this way, while determining a value of the reference current If, it is unnecessary to consider cleaning the voltage at the anode of the light emitting device 4, such that the value of the reference current If may be determined more easily. Secondly, in this way, the voltage written at the anode of the light emitting device 4 from the voltage cleaning module 5 and the voltage written at the second end of the capacitor C from the first reference voltage generation module 3 may be controlled independently, resulting in a simpler and more reliable control means.

To sum up, in the pixel compensation circuit according to the embodiments of the present disclosure, before the light emitting device 4 emits light, the first reference voltage generation module 3 writes at the second end of the capacitor C and the gate electrode of the driving transistor DTFT a voltage including a threshold voltage Vth component of the driving transistor DTFT, such that the driving current generated during the light emitting period of the light emitting device 4 is irrelevant to the threshold voltage of the driving transistor DTFT. In this way, brightness of the light emitting device 4 will not be affected by the uniformity of the manufacturing process of the driving transistor DTFT and the shift occurred in the threshold voltage Vth during the illumination, thereby preventing a brightness change of the light emitting device 4 during the illumination and improving brightness uniformity during the illumination. In addition, during the illumination period of the light emitting device 4, the capacitor C is kept floated, such that a voltage difference across both ends of the capacitor, i.e., the voltage difference between the gate electrode and the source electrode of the driving transistor DTFT, remains constant. Accordingly, the driving current does not change as the voltage of the high voltage signal terminal VDD changes, thereby further preventing a brightness change of the light emitting device 4 during the illumination and improving brightness uniformity during the illumination.

Embodiments of the present disclosure further provide an AMOLED display device. The AMOLED display device includes the pixel compensation circuit according to the previous embodiments.

In the AMOLED display device according to the embodiments of the present disclosure, by using the above pixel compensation circuit, it is possible to prevent the brightness change of the light emitting device in each pixel in one frame of image, and prevent the brightness non-uniformity of the light emitting device in each pixel due to the manufacturing process of the driving transistor in each pixel, thereby improving the display effect and display uniformity.

It should be appreciated that, the above embodiments are exemplary implementations for illustrating the principle of the present disclosure, while the present disclosure is not limited thereto. Various modifications and improvements can be made by those ordinary skilled in the art without departing from the spirit and essential of the present disclosure. All these modifications and improvements will also fall into the protection scope of the present disclosure.

What is claimed is:

1. A pixel compensation circuit comprising:

a capacitor;

a driving transistor;

a light emitting device;

a data signal writing circuit connected to a first end of the capacitor;

a high voltage writing circuit connected to the first end of the capacitor; and a first reference voltage generation circuit connected to a second end of the capacitor, an anode of the light emitting device and a drain electrode of the driving transistor, wherein a gate electrode of the driving transistor is connected to the second end of the capacitor, a source electrode of the driving transistor is connected to the high voltage writing circuit, and the drain electrode of the driving transistor is connected to the anode of the light emitting device; and wherein a cathode of the light emitting device is connected to a common grounding electrode, wherein the high voltage writing circuit comprises a high voltage signal terminal and a second transistor, and wherein a control electrode of the second transistor is connected to a light emitting signal terminal, a source electrode of the second transistor is connected to the high voltage signal terminal, and a drain electrode of the second transistor is connected to the first end of the capacitor.

2. The pixel compensation circuit according to claim 1, wherein the data signal writing circuit comprises a data signal line and a first transistor, and wherein:

a control electrode of the first transistor is connected to a gate line, a source electrode of the first transistor is connected to the data signal line, and a drain electrode of the first transistor is connected to the first end of the capacitor.

3. The pixel compensation circuit according to claim 1, wherein the first reference voltage generation circuit comprises a reference current terminal, a third transistor and a fourth transistor, and wherein:

a control electrode of the third transistor is connected to the gate line, a source electrode of the third transistor is connected to the reference current terminal, and a drain electrode of the third transistor is connected to a source electrode of the fourth transistor, the drain electrode of the driving transistor and the anode of the light emitting device; and a control electrode of the fourth transistor is connected to the gate line, and a drain electrode of the fourth transistor is connected to the second end of the capacitor.

4. The pixel compensation circuit according to claim 1, wherein the light emitting device is an organic light emitting diode (OLED).

5. The pixel compensation circuit according to claim 1, further comprising a voltage cleaning circuit, wherein:

the voltage cleaning circuit is connected between the drain electrode of the driving transistor and the anode of the light emitting device to input a second reference voltage to the anode of the light emitting device.

6. The pixel compensation circuit according to claim 5, wherein the voltage cleaning circuit comprises a second reference voltage signal terminal, a fifth transistor and a sixth transistor, and wherein:

a control electrode of the fifth transistor is connected to the light emitting signal terminal, a source electrode of the fifth transistor is connected to the drain electrode of the driving transistor, and a drain electrode of the fifth transistor is connected to the anode of the light emitting device; and a control electrode of the sixth transistor is connected to the gate line, a source electrode of the sixth transistor is connected to the second reference voltage signal terminal, and a drain electrode of the sixth transistor is connected to the anode of the light emitting device.

7. An active matrix organic light emitting diode (AMOLED) display device, comprising a pixel compensation circuit, wherein the pixel compensation circuit comprises a data signal writing circuit, a high voltage writing circuit, a first reference voltage generation circuit, a driving transistor, a capacitor and a light emitting device, wherein:

the data signal writing circuit is connected to a first end of the capacitor;

the high voltage writing circuit is connected to the first end of the capacitor;

the first reference voltage generation circuit is connected to a second end of the capacitor, an anode of the light emitting device and a drain electrode of the driving transistor;

a gate electrode of the driving transistor is connected to the second end of the capacitor, a source electrode of the driving transistor is connected to the high voltage writing circuit, and the drain electrode of the driving transistor is connected to the anode of the light emitting device; and a cathode of the light emitting device is connected to a common grounding electrode, wherein the high voltage writing circuit comprises a high voltage signal terminal and a second transistor, and wherein:

a control electrode of the second transistor is connected to a light emitting signal terminal, a source electrode of the second transistor is connected to the high voltage signal terminal, and a drain electrode of the second transistor is connected to the first end of the capacitor.

8. The AMOLED display device according to claim 7, wherein the data signal writing circuit comprises a data signal line and a first transistor, and wherein:

a control electrode of the first transistor is connected to a gate line, a source electrode of the first transistor is connected to the data signal line, and a drain electrode of the first transistor is connected to the first end of the capacitor.

9. The AMOLED display device according to claim 7, wherein the first reference voltage generation circuit comprises a reference current terminal, a third transistor and a fourth transistor, and wherein:

a control electrode of the third transistor is connected to the gate line, a source electrode of the third transistor is connected to the reference current terminal, and a drain electrode of the third transistor is connected to a source electrode of the fourth transistor, the drain electrode of the driving transistor and the anode of the light emitting device; and a control electrode of the fourth transistor is connected to the gate line, and a drain electrode of the fourth transistor is connected to the second end of the capacitor.

10. The AMOLED display device according to claim 7, wherein the light emitting device is an organic light emitting diode (OLED).

11. The AMOLED display device according to claim 7, wherein the pixel compensation circuit further comprises a voltage cleaning circuit, wherein:

the voltage cleaning circuit is connected between the drain electrode of the driving transistor and the anode of the light emitting device to input a second reference voltage to the anode of the light emitting device.

12. The AMOLED display device according to claim 11, wherein the voltage cleaning circuit comprises a second reference voltage signal terminal, a fifth transistor and a sixth transistor, and wherein:

a control electrode of the fifth transistor is connected to the light emitting signal terminal, a source electrode of the fifth transistor is connected to the drain electrode of the driving transistor, and a drain electrode of the fifth transistor is connected to the anode of the light emitting device; and a control electrode of the sixth transistor is connected to the gate line, a source electrode of the sixth transistor is connected to the second reference voltage signal terminal, and a drain electrode of the sixth transistor is connected to the anode of the light emitting device.

* * * * *